US010634407B2

(12) United States Patent
Grega

(10) Patent No.: US 10,634,407 B2
(45) Date of Patent: Apr. 28, 2020

(54) METHOD, IN PARTICULAR, FOR PRODUCING SNOW, AND A DEVICE FOR PERFORMING THE METHOD

(71) Applicant: Samuel Grega, Presov (SK)

(72) Inventor: Samuel Grega, Presov (SK)

(73) Assignee: OKEANOS CORPORATION (SC)

( * ) Notice: Subject to any disclaimer, the term of this patent is extended or adjusted under 35 U.S.C. 154(b) by 642 days.

(21) Appl. No.: 14/348,897

(22) PCT Filed: Oct. 1, 2012

(86) PCT No.: PCT/EP2012/004110

§ 371 (c)(1),
(2) Date: Apr. 1, 2014

(87) PCT Pub. No.: WO2013/045116

PCT Pub. Date: Apr. 4, 2013

(65) Prior Publication Data

US 2014/0246511 A1 Sep. 4, 2014

(30) Foreign Application Priority Data

Oct. 1, 2011 (SK) ..... 99-2011

(51) Int. Cl.
*F25C 3/04* (2006.01)

(52) U.S. Cl.
CPC ..... *F25C 3/04* (2013.01); *F25C 2303/044* (2013.01); *F25C 2303/048* (2013.01)

(58) Field of Classification Search
CPC .. F25C 3/04; F25C 2303/00; F25C 2303/042; F25C 2303/044; F25C 2303/046; F25C 2303/048; F25C 2303/0481
USPC ..... 239/2.2, 14.2
See application file for complete search history.

(56) References Cited

U.S. PATENT DOCUMENTS 5,400,965 A * 3/1995 Ratnik ..... F25C 3/04 239/14.2
6,161,769 A * 12/2000 Kircher ..... F25C 3/04 239/135
2009/0294547 A1* 12/2009 Ichinomiya ..... F25C 3/04 239/2.2

FOREIGN PATENT DOCUMENTS

JP H04116362 A * 4/1992
WO WO 2007/045467 4/2007

* cited by examiner

*Primary Examiner* — Jason J Boeckmann
(74) *Attorney, Agent, or Firm* — John Alumit

(57) ABSTRACT

A method, in particular for generating snow from water, using a low-pressure hydraulic device having a pump unit, to which a purification system is connected, and a distribution device having at least one high-pressure pump, to which a high-pressure unit having a snow cannon and/or a different snow-generating unit is connected. In order for the bonding of the water molecules in the supermolecular water structure of the process water to change and the generation of snow to improve, according to the invention at least part of the water used is exposed to an ionization field and/or a polarization field while simultaneously being exposed to the effects of an alternating electromagnetic field so that a weaker bonding of the water molecules in the supermolecular water structure is achieved, resulting in an improvement in the absorption and transfer of heat. The invention further relates to a device for carrying out the method.

8 Claims, 6 Drawing Sheets

METHOD, IN PARTICULAR, FOR PRODUCING SNOW, AND A DEVICE FOR PERFORMING THE METHOD

CROSS-REFERENCE TO RELATED APPLICATION

This application claims the priority filing date of international application no. PCT/EP2012/004110 filed on Oct. 1, 2012. The earliest priority date claimed is Oct. 1, 2011.

FEDERALLY SPONSORED RESEARCH

Not Applicable

SEQUENCE LISTING OR PROGRAM

Not Applicable

STATEMENT REGARDING COPYRIGHTED MATERIAL

Portions of the disclosure of this patent document contain material that is subject to copyright protection. The copyright owner has no objection to the facsimile reproduction by anyone of the patent document or the patent disclosure as it appears in the Patent and Trademark Office file or records, but otherwise reserves all copyright rights whatsoever.

BACKGROUND

The invention relates to a method, in particular, for producing snow, as defined by the preamble to claim 1 and to a device for performing the method.

The invention relates to a novel method and to a hydraulic, electronic and pneumatic device, in particular, for producing artificial snow, ice, or for similar technological processes.

Current methods and devices, particularly for producing snow or ice, have been designed differently, depending on what type of water source they have, e.g., a natural lake, an artificial lake, a river, a reservoir, a spring, etc. These resources have advantages, but also disadvantages. When artificial lakes form, they put limits on use in terms of both time and volume. The actual production of artificial snow is done by a combination of suitably disposed water and air nozzles on the snow device (snow cannon or other snowmaking devices). Production methods that cool or chemically treat the water used for producing snow, or that chemically enrich it, by means of micromaterials are also known. Snow and ice pellets form faster when coated with water. A number of exemplary embodiments of snow cannon, or other snowmaking devices, exist, but the feature they have in common is adjustability in the horizontal and vertical directions. At least one motion can be controlled automatically. The snow cannon, or other snowmaking devices, have a number of nozzles, which are either fixed or rotatable, and are preferably disposed upstream of an airflow source in a directional transit chamber.

The disadvantage of these known devices for producing snow or ice is that they are especially dependent on the temperature and humidity, as well as on the temperature and quantity of service water used for producing snow. The snow produced at below-freezing temperatures, and at 0° C., is wet, and this cannot be improved by existing means, such as production at a higher elevation, using less water, changing the pressure, or cooling the water. Under such conditions, either the production of artificial snow either has to be stopped, or snowmaking has to be done repeatedly at night when the conditions for producing snow are more favorable.

In WO 2007/045467, a device is described in which the medium is circulated and its temperature is increased in the process. This leads to increased energy consumption.

SUMMARY

It is the object of the invention to develop a method for producing snow in which the bond of water molecules in a supermolecular water structure of the water used, changes and thereafter improves the production of snow.

The stated object is attained by the features of claim 1.

The essence of the novel method is that the water used for producing snow is exposed to an ionization and/or polarization field with the simultaneous action of an alternating electromagnetic field. What is achieved thereby is that the force-energy bond of water molecules in the supermolecular water structure of the water used, changes; that is, it decreases. In this process, the medium (liquid and/or gas) flows through the device without a notable temperature increase. A further advantage is that the flow quantity of the medium in the device can be regulated.

Advantageous embodiments of a device for performing the method can be learned from the dependent claims.

The low-pressure and/or high-pressure part of the hydraulic circuit has a primary excitation device and/or a pressure excitation device connected directly, fixedly, and/or indirectly, in their circuit by way of a bypass, and with the excitation device, the flow of liquid can be interrupted. The primary excitation device is preferably disposed downstream of the cleaning device. It can also, with less-pronounced advantages, be installed at any arbitrary point of the hydraulic course, or at the water source upstream of the pumping device. The pressure excitation device is preferably connected to the high-pressure device upstream of the snow cannon and/or some other snowmaking device.

The primary excitation device has a hydraulic inlet branch with a second controlled opening and closing mechanism, which, in a distribution branch with at least one thermometer and/or one pressure gauge, discharges in the vicinity of the controlled main opening and closing mechanism. Between the inlet and the hydraulic outlet branches, excitation devices are secured fixedly and/or detachably. The hydraulic outlet branch discharges into an intermediate branch, which is disposed between a third controlled opening and closing mechanism and a main opening and closing mechanism.

The pressure excitation device comprises a common chamber, in which at least one control electrode is secured at the inlet, fixedly, detachably, and/or flexibly. At least one polarization electrode is secured fixedly and flexibly in the direction of flow at the common chamber's body outlet. The common chamber's body outlet is formed by a fixed and/or flexible sheath (film).

In the case of excitation devices at the primary excitation device, the common body predominantly comprises a sheath (film), which has a coating, at least partially on its circumference.

The advantage of the device, in particular for producing snow, is that high-quality snow can already be produced at 0° C. The snow produced is drier, and because it has multiple coatings, water does not escape from it. Hence, the quality of snow is maintained despite the need for the snow to be scattered by machines for whatever purpose. These machines compress the layers of snow, but do not force water out. Thus, a layer of ice cannot form. Similarly, there is no prerequisite for making, so-called, snow pellets in the spring. The artificial snow produced thaws more slowly, so snowmaking does not have to be repeated frequently. The result is reduced costs, especially electrical costs, for operating snow cannons, since there is no need to increase the already generous snow production. At the same time, the amount of water used is reduced, which has a positive environmental effect. As a result, the ski season can be extended, or shifted to lower-lying regions, with better-quality artificially produced snow. This is achieved because of the treatment, according to the invention, in which water, or other medium used, acquires unforeseen, unexpected, and newly discovered properties in terms of heat/cold consumption and output. This is also documented physically.

DRAWINGS

The invention will be described in further detail in conjunction with the drawings. In the drawings.

DESCRIPTION

Figure 1:
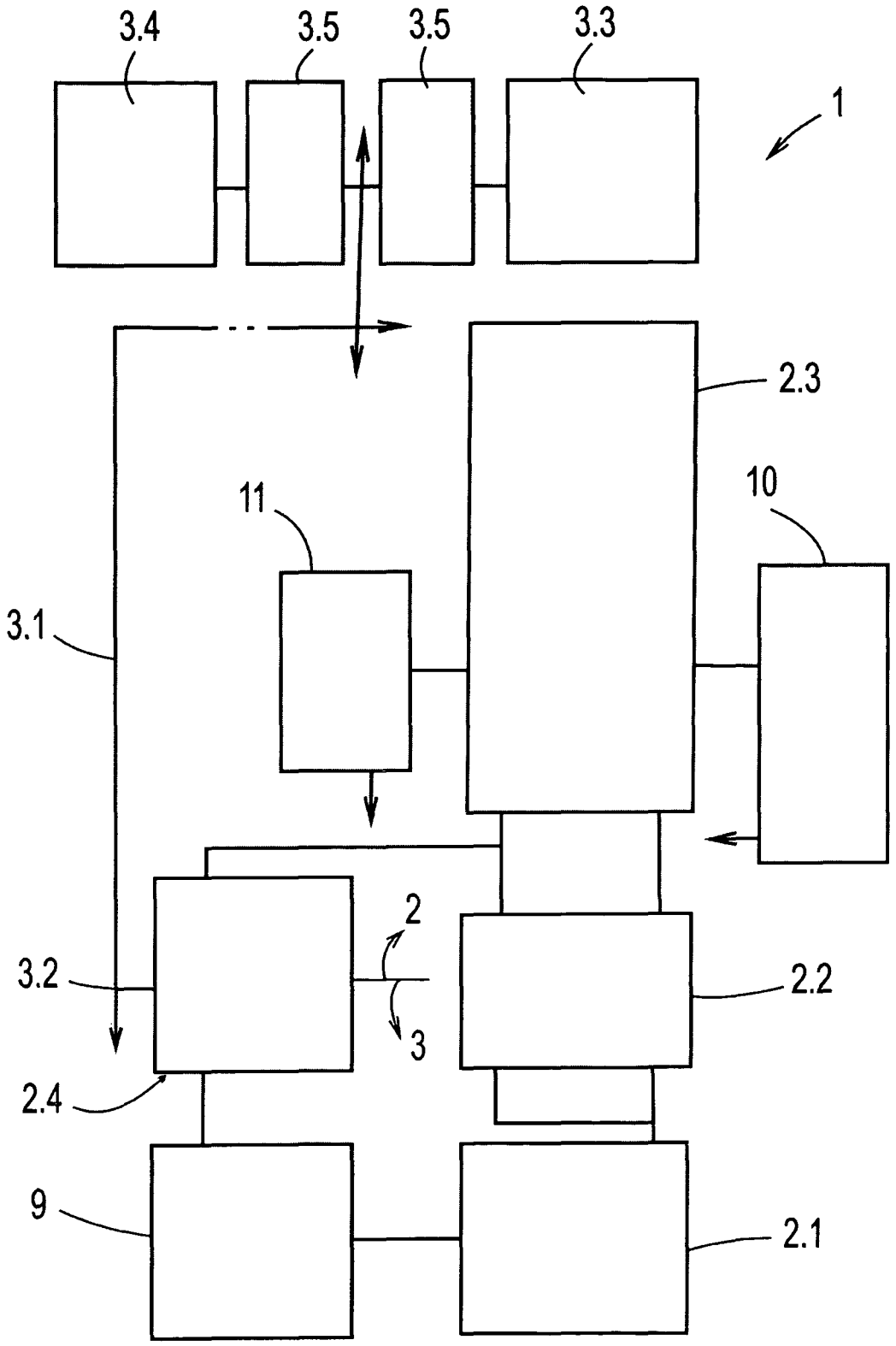
FIG. 1 is a hydraulic, electronic and pneumatic block diagram of a device.
Figure 2:
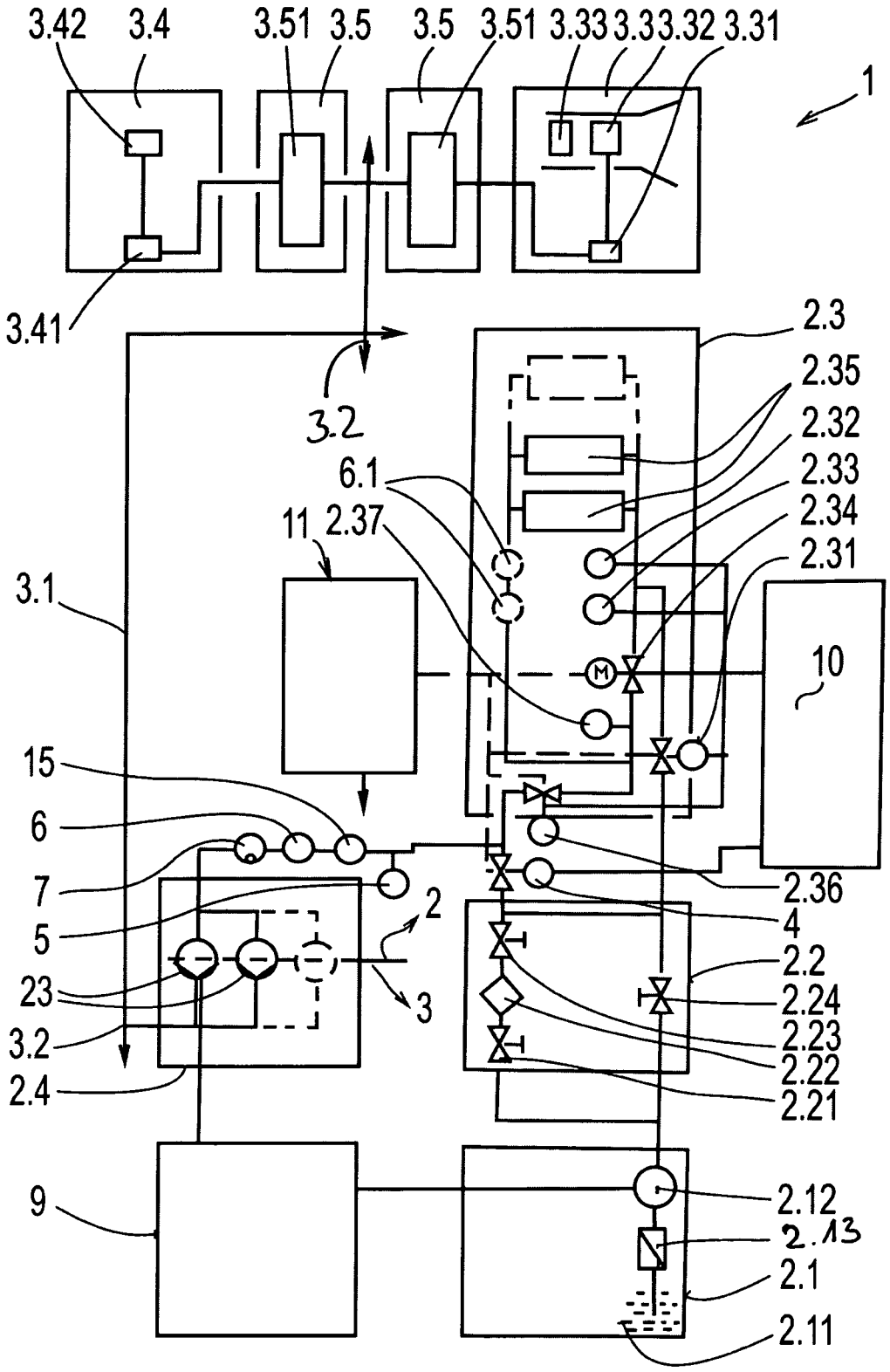
FIG. 2 shows a concrete exemplary embodiment of a hydraulic device with a concrete exemplary embodiment of a primary excitation device for producing snow, with a suitably controlled main opening and closing mechanism.
Figure 3:
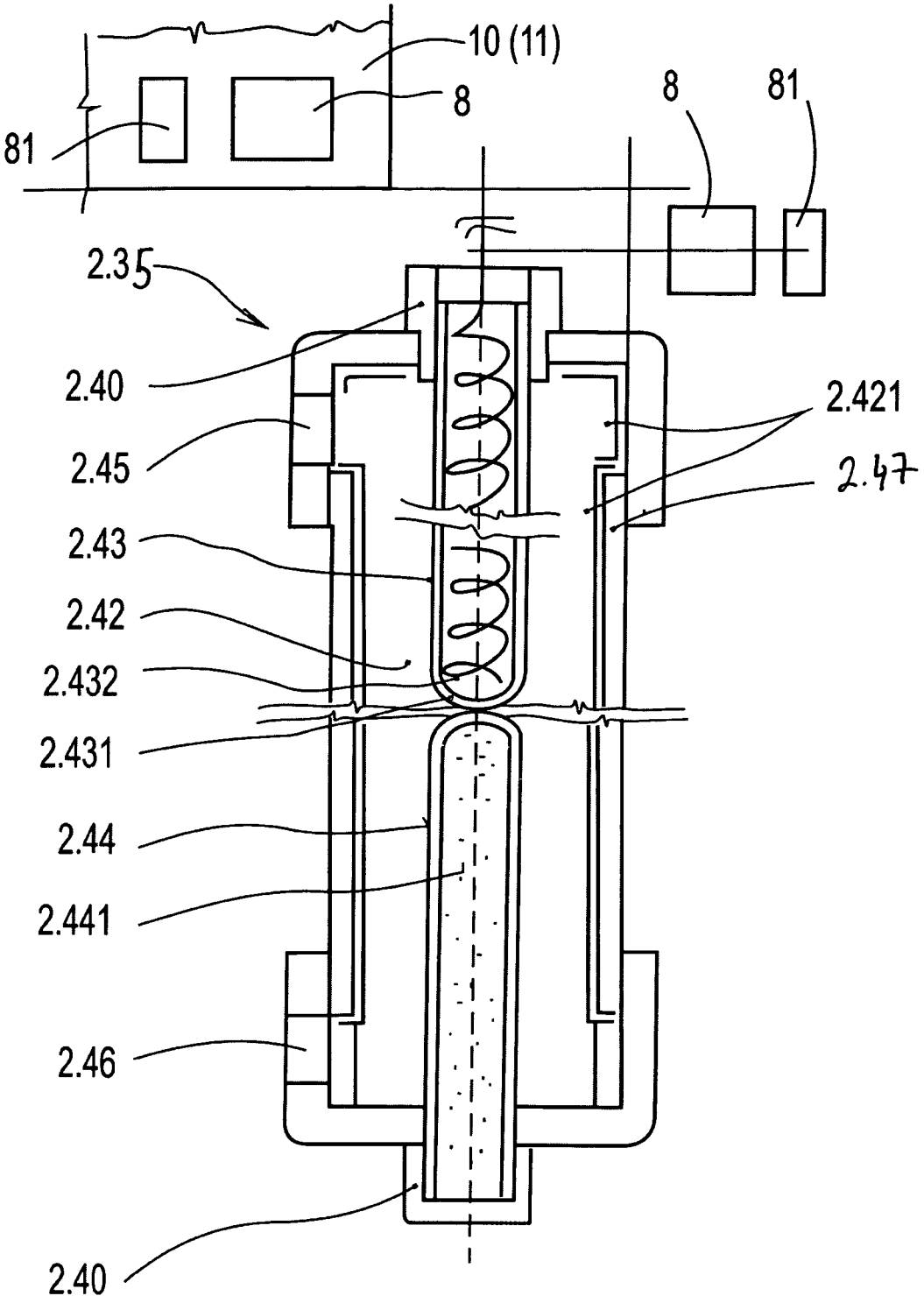
FIG. 3 shows an excitation device at the primary excitation device, showing a high-power source that is supported in its own control device, and ,in an equivalent exemplary embodiment, is connected directly to the excitation device.
Figure 4:
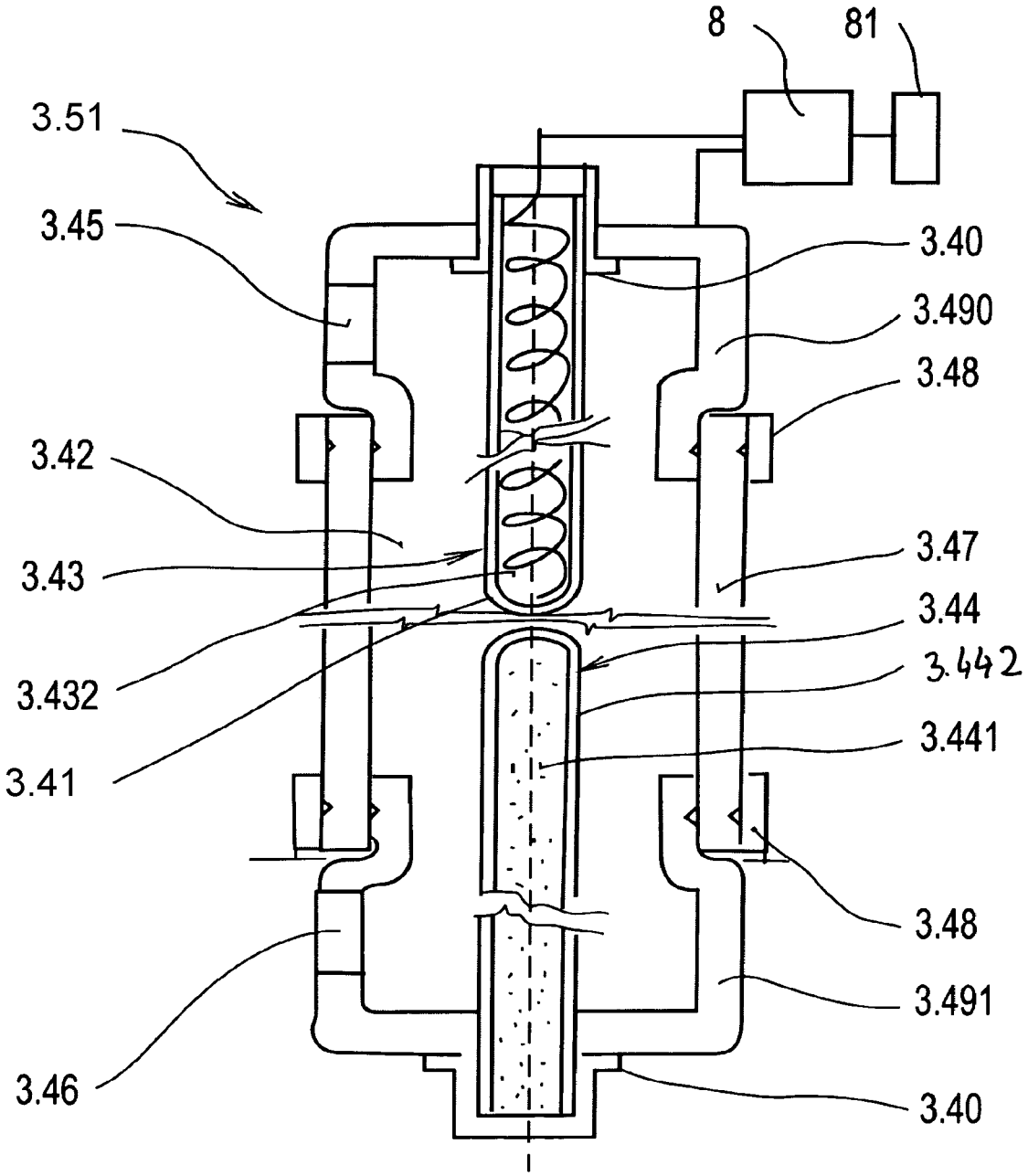
FIG. 4 shows a pressure excitation device, the part of which has a flexible sheath between the inlet and the outlet.

The method and the device, particularly for producing snow, comprise a hydraulic distributor device 2.4 with at least one high-pressure pump. A high-pressure device 3 comprises a pressure line 3.1, which has a number of exemplary embodiments. They can be fixed and/or flexible and can comprise steel, polyethylene, polypropylene, textile, or rubber, with distributor devices 3.2. A snow cannon 3.3 and/or other snowmaking devices 3.4 can be connected as needed to the high-pressure device 3 in such a way that upstream of the high-pressure device, pressure excitation blocks 3.5 with at least one pressure excitation device 3.51 are connected to the pressure line 3.1. The snow cannon 3.3 has a distributor device 3.31, which communicates hydraulically with a nozzle device 3.32 disposed in the interstice or on its end, preferably in the inside. The nozzle device 3.32 is disposed in the direction of the airflow out of an air module 3.33. The distributor device 3.31 is connected to pressure, temperature, flow and moisture sensors, etc., each of which has its own control module and algorithm of physical variables.

Similarly, rod-type snow blocks 3.4 have a second technological distributor device 3.41, which is connected to a second nozzle device 3.42. The snow cannons 3.3 and the rod-type snow blocks 3.4 are placed in a manner that suits the type of terrain.

The low-pressure device 2 of the hydraulic device 1 includes a pumping device, to which a cleaning device is connected that is connected fixedly or detachably to the primary excitation device 2.3. A distributor device 2.4, whose at least one high-pressure pump 23 separates the low-pressure device 2 from the high-pressure device 3, is connected downstream of the primary excitation device 2.3.

The pumping device 2.1 comprises a reservoir 2.11, which is a spring, river, lake, or reservoir with a suction pipeline let into the pumping device. Downstream of the suction device, a filter 2.13 is disposed upstream of the pump 2.12. The pumping device 2.1 has a number of exemplary embodiments with measuring instruments for measuring the inflow, temperature, pressure, level, etc., which are preferably, like the pump 2.12, connected electrically to the primary excitation device 9.

The cleaning device 2.2 includes a technological branch, on which a first opening and closing mechanism 2.21 is disposed, downstream of which a filter 2.22 is preferably connected. Downstream of the filter 2.22, there is a second opening and closing mechanism 2.23. The connecting branch includes a third opening and closing mechanism 2.24. The technological branch communicates with the connection branch both downstream of the pumping device 2.12 and downstream of the second opening and closing mechanism 2.23. Downstream of the technological branch is a first controlled opening and closing mechanism 4, and downstream of the first controlled opening and closing mechanism is a connection branch, which includes a pressure gauge 5, a venting device 6, and a flow meter 7 upstream of the inlet into the distributor device 2.4.

At the hydraulic inlet branch, the primary excitation device 2.3 has a second controlled opening and closing mechanism 2.31, which discharges into a distribution branch with at least one thermometer 2.32 and one pressure gauge 2.33. The distribution branch is located upstream of the main opening and closing mechanism 2.34. Between the distribution branch and the output hydraulic branch, at least one excitation device 2.35 is secured fixedly or detachably. The hydraulic inlet branch discharges into an intermediate branch, which connects the third controlled opening and closing mechanism 2.34 to a main opening and closing mechanism 2.36 and at which intermediate branch an outlet pressure gauge 2.37 is preferably disposed. It is advantageous if at least one venting excitation device 6.1 is connected to the hydraulic outlet branch.

The pressure excitation device 3.5 comprises at least one pressure excitation device 3.51 with a common chamber 3.42, which has at least one control electrode 3.43 in the vicinity of the inlet opening 3.45 and a polarization electrode 3.44 in the vicinity of the outlet opening 3.46. The control electrode 3.43 is supported flexibly and/or fixedly, and in watertight fashion in a holder 3.40. This holder 3.40 is connected in watertight fashion to an inlet sheath (film) 3.490. The input sheath 3.490 includes an inlet opening 3.45. The polarization electrode 3.44 is supported flexibly and/or fixedly and in watertight fashion in the holder 3.40. This holder 3.40 is connected in watertight fashion to an outlet sheath (film) 3.491 and includes an outlet opening 3.46. It is advantageous if the inlet sheath (film) 3.490 and the outlet sheath (film) 3.491 are connected to one another via a deformation sheath (film) 3.47 of flexible, bendable pressure material. A concrete exemplary embodiment of the connection provides a coupling 3.48. For example, this is a hydraulic hose of synthetic rubber. The synthetic rubber has high resistance to wear and environmental factors. It is advantageous if at least a portion of the common chamber 3.42 comprises a material with a negative electrochemical potential and/or is disposed outside the deformation sheath (film) 3.47. The control electrode 3.43 has a sheath 3.41 in the form of a test tube, which is a tube of silicate, ceramic or like material, in which a rodlike and/or spiral antenna 3.432 is disposed. The polarization electrode 3.44 is embodied similarly, but in its interior the polarization electrode has a fixed, liquid or gaseous polarization material 3.441. The sheath 3.41 of the control electrode 3.43 and the sheath of the polarization electrode 3.44 have a number of versions, depending on the load and type of excitation water (medium) used. For the lowest load, the sheath comprises technical glass with a predominant proportion of $SiO_2$. This is a homogeneous, amorphous, isotropic, solid and fragile substance, which, in a metastable state, has a tensile strength of 30 MPa and a density of approximately 2.53 g $cm^{-3}$. This is an insulating material with dielectric properties that has polarization capabilities. An oxidic sintered ceramic with an $Al_2O_3$ content of at least 99.7%, or a microstructured ceramic of oxygen with a modulus of elasticity in tension of 380-400 GPa, a breaking strength of at least 300 MPa and a density of 3.8 g $cm^3$, is suitable. What is best is a composite ceramic C/SiC, which is in the category of nontoxic technical ceramics and has short carbon fibers, which improve the excellent mechanical and thermal properties of K/SiC. Its density is 2.65 g $cm^{-3}$; the modulus of elasticity is 250-350 GPa and the bending strength is at least 160-200 MPa. The composite ceramic C/SiC includes short carbon fibers with a length of 3-6 mm and a Rovince thickness of 12 k (1 k=$10^3$ filaments), which can be oriented volumetrically and randomly, as a result of which the material then has isotropic properties. Under extreme load on the polarization electrode 3.44 or control electrode 3.43, the short carbon fibers can preferably be oriented in a targeted way, for instance, perpendicularly to the axis, as a result of which the material gains anti-isotropic properties. The spiral or rod antenna 3.432 is connected detachably or fixedly to a high-power source 8, which is connected to a power supply 8.1. The high-power source 8, if the excitation device is located in water, feeds an alternating electromagnetic signal of 100-500 MHz with an intensity of 0.1-2.0 W into the rodlike and/or spiral antenna 3.432. The power supply 8.1 is understood to be a 230 V source, which is converted into 12 V (24 V and the like). It can also be a technical equivalent, such as a battery, solar or photoelectric element, or like material. In an alternative version, the high-power source 8 can also be disposed outside the pressure excitation device 3.51.

An excitation device 2.35, which corresponds to the elastic pressure excitation device 3.51, is disposed on the primary excitation device 2.3 and has a common chamber 3.42, in which at least one control electrode is secured in watertight fashion, fixedly or detachably, in the vicinity of the inlet opening 2.45. In the vicinity of the outlet opening 2.46, a polarization electrode 2.44 is secured fixedly or detachably and in watertight fashion. On the circumference of the common chamber 2.42 or on at least a portion thereof, there is a coating, film or sheath 2.421 of positive electrochemical material (C, Cu, etc.) or negative electrochemical material (Al, Fe, etc.), depending on the composition of the water (or medium). In the exemplary embodiment described, a storage housing 2.47 comprises nonconductive plastic (dielectric) insulating material. In the concrete exemplary embodiment, this is polypropylene. The control electrode 2.43 and the polarization electrode 2.44 are supported in the holder 2.40. The control electrode 2.43 has a closed sheath 2.431 of tubular shape, in which a rodlike or spiral antenna 2.432 is disposed. The polarization electrode 2.44 is constructed similarly, and ,in its interior, the polarization electrode has a solid, liquid or gaseous content 2.441 with a positive and/or negative electrochemical potential. It is advantageous if, as in a further exemplary embodiment, the polarization electrode has an openable and closeable ventilation and sludge removal opening. Some elements and nodes, which form a novel device for producing snow or ice, are connected electronically to a primary control device 9 and a pneumatic device 11. These are, for example, a pump 2.12, high-pressure pump 23, flow meter 7, temperature and pressure gauges, and measuring instruments for other physical variables. The primary excitation node 2.3 has its own control device 10 and pneumatic device 11, both of which are connected to a first controlled opening and closing mechanism 4, a second controlled opening and closing mechanism 2.31, a controlled main opening and closing mechanism 2.34, and a third opening and closing mechanism 2.36. The control device 10 itself is connected to a thermometer 2.32, a pressure gauge 2.33, and an outlet pressure gauge 2.37, or to an external thermometer (not shown in the drawing). It is advantageous if the low-pressure hydraulic device 2, downstream of the excitation device, has at least one ventilation node 15, or if the primary excitation device 23 has its own ventilation device 6.1. The phrase "material with a positive or negative electrochemical potential" is understood to mean an electrode potential $E^0$. Only the electromotive voltages of the member that are generated by the defined electrode and comparison electrode are measured. The standard comparison electrode has an electrode potential equal to zero, $E^0=0$, which is equivalent to a platinum electrode prepared in a standard way. The values of standard electrode potentials range from −3.04 V (lithium) to +1.52 V (gold). Especially good outcomes are achieved by a polarization electrode of silver, even if the chamber sheath either entirely or only partially comprises stainless steel. This process is analyzed continuously by a device according to Slovakian Patent 279 429 of Polakovič-Polakovičová. With the Po process, it is documented and proven that the water molecules prepared in the excitation devices are bound more weakly to one another than in untreated water. The method can be defined as a passage of a liquid medium, water, or at least a portion of the liquid medium's volume, through a polarization and/or ionization chamber under the influence of an alternating electromagnetic signal. As a result, the molecules of the medium (the water molecules in the supermolecular structure), have a weaker bond. The force energy of the bonds in the molecular and supermolecular water structure vary, but only to such an extent that the fluidity of the force energy of the bonds varies; however, the liquid properties are preserved (the aggregate status remains unchanged).

Figure 5:
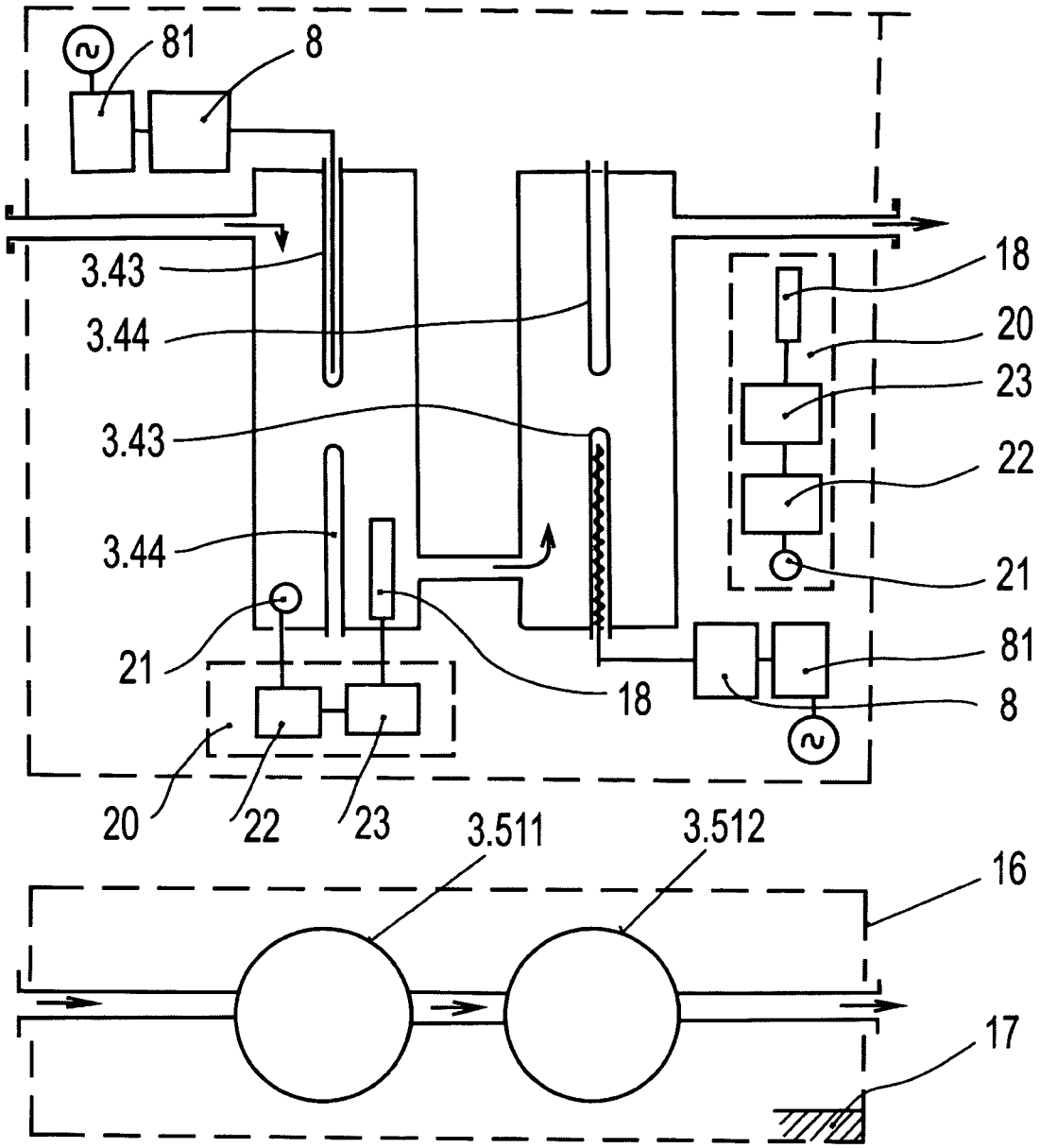
FIG. 5 shows a concrete exemplary embodiment of a pressure excitation device or its equivalent, comprising two devices in succession that are supported in an air chamber by heat insulation, which has a controlled heating element in the interior of the hydraulic portion and/or in the air chamber.
Figure 6:
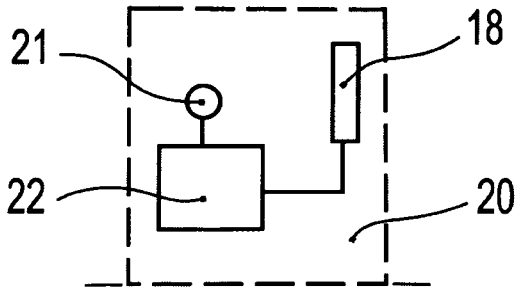
FIG. 6 shows a simplified embodiment of temperature and/or motion control for the medium.
Figure 7:
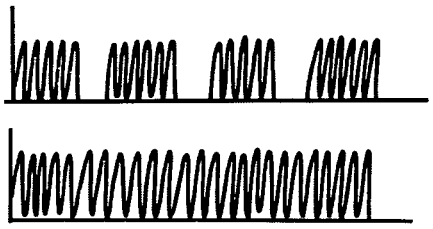
FIG. 7 shows variants of the electromagnetic signal.

The exemplary embodiment of FIG. 5 comprises a sheath 16, on which a heat insulator 17 is disposed on the outside or inside. A pressure excitation device 3.511 and a second pressure excitation device 3.512, or a plurality of excitation devices communicating hydraulically with one another, are located in the sheath 16. Each excitation device has its own high-power source 8, which is connected to its own or a common power supply 8.1. In the interior of the hydraulic device, there is at least one heating element 18, which is connected to a temperature controller 20 and/or a motion controller for the medium. In another concrete exemplary embodiment, the control device 20 is located in the sheath 16. The control device 20 includes a sensor 21, which is connected to an evaluation unit 22 (such as a thermostat), which is connected to a switch element 23. The heating element 18 is formed by a resistance wire, rodlike wire, or spiral wire. If the heating element 18 is in the interior, it can also be a laser beam or an induction heating element 18, and optionally, a suitably powerful plasma heating element. This is necessary to avoid freezing and the ensuing damage, or to reverse them. The primary excitation device 2.3 can also be connected without controlled opening and closing mechanisms (2.34; 2.36; 2.31 and 4), specifically, with a manual control in the form of a bypass.

What is claimed:

1. An apparatus for producing snow from water, the apparatus comprising:

a low-pressure hydraulic device (2) having a pumping device (2.1);

a cleaning device (2.1) to which a high-pressure device (3) with a snow cannon (3.3) is attached;

wherein some of the water is exposed to an ionization field, the ionization field comprising an alternating electromagnetic polarization field, thereby weakening molecular bonds in molecules of the water, and improving the transmission of heat therein; and a primary excitation device (2.3) including a hydraulic inlet branch having a controlled opening and closing mechanism (2.31);

wherein the hydraulic inlet branch discharges into a distribution branch having a thermometer (2.32) and a pressure gauge (2.33);

wherein the primary excitation device (2.3) comprises the hydraulic inlet branch and a hydraulic outlet branch, with an excitation device (2.35) secured between them, and the excitation device (2.35) discharges into a controlled main opening and closing mechanism (2.36); and wherein the excitation device (2.35) has a common chamber (2.42) having a film (2.421) and a control electrode (2.42), the film (2.421) and the control electrode (2.43) being connected to a power source (8), the power source emitting an alternating electromagnetic signal of from 100 to 500 MHz, with an intensity of from 0.1 to 100 W.

2. An apparatus for producing snow from water, the apparatus comprising:

a low-pressure hydraulic device (2) having a pumping device (2.1);

a cleaning device (2.1) to which a high-pressure device (3) with a snow cannon (3.3) is attached;

wherein some of the water is exposed to an ionization field, the ionization field comprising an alternating electromagnetic polarization field, thereby weakening molecular bonds in molecules of the water, and improving the transmission of heat therein; and a primary excitation device (2.3) including a hydraulic inlet branch having a controlled opening and closing mechanism (2.31);

wherein the hydraulic inlet branch discharges into a distribution branch having a thermometer (2.32) and a pressure gauge (2.33);

wherein the primary excitation device (2.3) comprises the hydraulic inlet branch and a hydraulic outlet branch, with an excitation device (2.35) secured between them, and the excitation device (2.35) discharges into a controlled main opening and closing mechanism (2.36); and wherein a pressure excitation block (3.5) disposed on the high pressure device (3) comprises a pressure excitation device (3.51), the pressure excitation device (3.51) having a common chamber (2.42) with an inlet opening (3.45) and an outlet opening (3.51) having a common chamber (2.42) with an inlet opening (3.45) and an outlet opening (3.46), a control electrode (3.43) adjacent the inlet opening (3.45) and a polarization electrode (3.44) adjacent the outlet opening (3.46), further comprising an inlet film (3.490) connected to the inlet opening (3.45) and an outlet film (3.491) connected to the outlet opening (3.46), the inlet film (3.490) and the outlet film (3.491) connected by a deformation film (3.47), and wherein the control electrode (3.43) is connected to a power source (8), the power source emitting an alternating electromagnetic signal of from 100 to 500 MHz, with an intensity of from 0.1 to 100 W.

3. The apparatus of claim 2 wherein the control electrode (3.43) has a casing in the form of a tube with a spiral antenna (3.42) disposed therein and the polarization electrode (3.44) has a casing in the form of a tube with a polarization material (3.44) disposed therein, wherein the control electrode (3.43) and the polarization electrode (3.44) tubes have a predominant proportion of $SiO_2$, with a tensile strength of 30 MPa and a density of 2.53 g $cm^{-3}$.

4. The apparatus of claim 2, wherein the control electrode (3.43) has a casing in the form of a tube with a spiral antenna (3.42) disposed therein and the polarization electrode (3.44) has a casing in the form of a tube with a polarization material (3.44) disposed therein, wherein the control electrode (3.43) and the polarization electrode (3.44) tubes comprise oxidic sintered ceramic having an $Al_2O_3$ content of at least 99.7%, a tensile modulus of elasticity of from 380 to 400 GPa, a bending strength of 300 MPa, and a density of 3.8 g $cm^{-3}$.

5. The apparatus of claim 2, wherein the control electrode (3.43) has a casing in the form of a tube with a spiral antenna (3.42) disposed therein and the polarization electrode (3.44) has a casing in the form of a tube with a polarization material (3.44) disposed therein, wherein the control electrode (3.43) and the polarization electrode (3.44) tubes comprise composite ceramic C/SiC, a density of 2.65 g $cm^{-3}$, a modulus of elasticity of from 250 to 350 GPa, and a bending strength of at least 160-200 MPa.

6. The apparatus of claim 2 wherein the pressure excitation device (3.51) includes a common chamber (2.42), the chamber at least partially coated by a coating (2.421), the coating (2.421) comprising an electrochemical material chosen from the list of C, Cu, Al, and Fe.

7. The apparatus of claim 2 wherein control electrode (2.43) is a platinum electrode with an electrode potential of −3.04 V (lithium) to +1.52 V (gold).

8. An apparatus for producing snow from water, the apparatus comprising:

a low-pressure hydraulic device (2) having a pumping device (2.1);

a cleaning device (2.1) to which a high-pressure device (3) with a snow cannon (3.3) is attached;

wherein some of the water is exposed to an ionization field, the ionization field comprising an alternating electromagnetic polarization field, thereby weakening molecular bonds in molecules of the water, and improving the transmission of heat therein; and a primary excitation device (2.3) including a hydraulic inlet branch having a controlled opening and closing mechanism (2.31);

wherein the hydraulic inlet branch discharges into a distribution branch having a thermometer (2.32) and a pressure gauge (2.33);

wherein the primary excitation device (2.3) comprises the hydraulic inlet branch and a hydraulic outlet branch, with an excitation device (2.35) secured between them, and the excitation device (2.35) discharges into a controlled main opening and closing mechanism (2.36); and further comprising a sheath (16) having a heat insulator, the sheath (16) containing a first pressure excitation device (3.511) and a second pressure excitation device (3.512) in hydraulic communication with each other, the first pressure excitation device (3.511) and the second pressure excitation device (3.512) each having its own high-power source (8).

* * * * *